US009233419B2

(12) United States Patent
Gries

(10) Patent No.: US 9,233,419 B2
(45) Date of Patent: Jan. 12, 2016

(54) MOLYBDENUM METAL POWDER

(71) Applicant: Benno Gries, Wolfenbuettel (DE)

(72) Inventor: Benno Gries, Wolfenbuettel (DE)

(73) Assignee: H.C. Starck Inc., Newton, MA (US)

( * ) Notice: Subject to any disclaimer, the term of this patent is extended or adjusted under 35 U.S.C. 154(b) by 245 days.

(21) Appl. No.: 13/968,770

(22) Filed: Aug. 16, 2013

(65) Prior Publication Data

US 2014/0037491 A1 Feb. 6, 2014

Related U.S. Application Data

(62) Division of application No. 13/124,814, filed as application No. PCT/IB2009/007311 on Oct. 14, 2009, now Pat. No. 8,562,715.

(60) Provisional application No. 61/109,347, filed on Oct. 29, 2008.

(30) Foreign Application Priority Data

Oct. 17, 2008 (DE) ..... 10 2008 051 784

(51) Int. Cl.

| | |
|---|---|
| ***C22C 27/04*** | (2006.01) |
| ***B22F 1/00*** | (2006.01) |
| ***B22F 9/22*** | (2006.01) |
| ***C22B 5/14*** | (2006.01) |
| ***C22B 34/34*** | (2006.01) |

(52) U.S. Cl.

CPC ..... *B22F 1/0003* (2013.01); *B22F 9/22* (2013.01); *C22B 5/14* (2013.01); *C22B 34/34* (2013.01); *C22C 27/04* (2013.01); *B22F 2201/013* (2013.01); *B22F 2301/20* (2013.01); *B22F 2999/00* (2013.01)

(58) Field of Classification Search

None

See application file for complete search history.

(56) References Cited

U.S. PATENT DOCUMENTS

| | | | | |
|---|---|---|---|---|
| 4,624,700 | A | 11/1986 | Port et al. | |
| 5,330,557 | A | 7/1994 | May | |
| 6,626,976 | B2 * | 9/2003 | Khan et al. | 75/369 |
| 2001/0049981 | A1 | 12/2001 | Mccormick | |
| 2005/0061106 | A1 * | 3/2005 | Ibaraki et al. | 75/245 |
| 2006/0086205 | A1 | 4/2006 | Johnson et al. | |
| 2006/0204395 | A1 | 9/2006 | Johnson | |

FOREIGN PATENT DOCUMENTS

| | | | |
|---|---|---|---|
| CN | 101200000 | A | 6/2008 |
| EP | 1162281 | A1 | 12/2001 |
| EP | 1308526 | A | 5/2003 |

OTHER PUBLICATIONS

International Preliminary Report on Patentability mailed Apr. 19, 2011 for International Application No. PCT/IB2009/007311 (8 pages).

International Search Report mailed Aug. 23, 2010 for International Application No. PCT/IB2009/007311 (5 pages).

Werner V. Schulmeyera and Hugo M. Ortner: "Mechanisms of the Hydrogen Reducion of Molybdenum Oxides", International Journal of Refractory Metals and Hard Materials, vol. 20, 2002, pp. 261-269.

Extended International Search Report mailed Apr. 15, 2014 for European Application No. EP 13 19 1201 (7 pages).

* cited by examiner

*Primary Examiner* — George Wyszomierski

(74) *Attorney, Agent, or Firm* — Morgan, Lewis & Bockius LLP

(57) ABSTRACT

The invention relates to a process for producing sinterable molybdenum metal powder in a moving bed, sinterable molybdenum powder and its use.

15 Claims, No Drawings

MOLYBDENUM METAL POWDER

CROSS-REFERENCE TO RELATED APPLICATIONS

This application is a divisional of U.S. patent application Ser. No. 13/124,814, filed May 19, 2011, now U.S. Pat. No. 8,562,715 which is the U.S. national stage application of International (PCT) Patent Application Serial No. PCT/IB2009/007311, filed Oct. 14, 2009, which claims the benefit of U.S. Provisional Patent Application 61/109,347, filed Oct. 29, 2008, and German Patent Application No. 10-2008-051784.4, filed Oct. 17, 2008. The entire disclosure of each of these applications is hereby incorporated by reference.

The invention relates to a process for producing sinterable molybdenum metal powder in a moving bed, sinterable molybdenum powder and its use.

Molybdenum metal powder, later also referred to as Mo powder, is used on a large scale for producing sintered solid molybdenum by powder metallurgy ("PM") processes. "PM" refers to the pressing of any metal or alloy powder to give a compact which is then sintered under reduced pressure or in hydrogen or in the two in succession. In the case of molybdenum, sintering is followed by hot or cold forming steps such as rolling, forging, extrusion or deep drawing and wire drawing in order to produce finished parts such as sheets, shaped bodies, round rods or wire. Owing to the tensile forces acting on the solid molybdenum in these forming steps, the occurrence of pores and inclusions ("defects") in the sintered part has to be avoided as far as possible (about 94% of the theoretical density is desirable, with 10.22 g/cm$^3$ being assumed as theoretical density). These defects result in low tensile strength and/or low elongation at break since they are the starting points of cracks and fractures and are thus responsible for failure in forming steps. ASTM B 386-03 demands a particular minimum tensile strength which can only be achieved when a particular minimum density is achieved in the sintered state before forming and the formed part does not contain any defects. Nonmetallic elements such as oxygen or carbon also have to be kept at the lowest possible level because these make the molybdenum brittle (i.e. reduce the ductility or maleability), which in forming steps also leads to fractures. ASTM D 386-03 describes the maximum content of these elements, for example oxygen and carbon. In the case of a molybdenum part produced by means of PM, a maximum of 70 ppm of oxygen are specified (ASTM material number 361), while the specification for molybdenum melted by the vacuum electron beam process is ≤15 ppm of oxygen.

To avoid a high reject rate as a result of fracture in forming steps, it is therefore necessary to bring the density to a high value after sintering and reduce the oxygen content in the sintered part to a very low value. This is sometimes very difficult to achieve by means of PM processes and 70 ppm of oxygen as specified in ASTM B 386-03 are considered to be a concession which merely represents a compromise between the requirements of the forming steps and the achievability by means of PM processes. This means that the Mo metal powder for producing sintered parts should have inherent properties which help to achieve a target of 70 ppm or better after sintering, with 15 ppm being a desirable objective. Secondly, the sintered density should be very high.

Control of oxygen in the sintered part requires control over two processes which compete during the sintering process: firstly the sintering process itself in terms of the shrinkage during sintering, which results in a loss of and reduction in the porosity, and secondly control over the removal of residual oxygen from the powder by means of diffusion of hydrogen into the pores of the compact, followed by output diffusion of water vapor through the pores. The latter requires the presence of open porosity which, as a network, has a connection to the outer surface. The densification of the body competes with this in that the porosity becomes increasingly closed and diffusion through the pores stops. The two processes are naturally subject to particular kinetics and therefore depend to different extents on the temperature. The correct choice of the rate of increase in the temperature during sintering is therefore the most important factor. A person skilled in the field of powder metallurgy of molybdenum would assume that Mo powders having oxygen contents of more than 1500 ppm are unsuitable for producing low-oxygen sintered parts because this cannot be removed completely during sintering. Mo powders having a relatively high specific BET surface area still contain too much oxygen even when they have been reduced completely. This can be attributed to the adsorption of water or oxygen by the powders in air, e.g. during sieving or filling processes. A completely reduced Mo powder which no longer contains $MoO_2$ has a typical oxygen content of 1000 ppm per m$^2$/g of specific surface area (BET) when it is analyzed immediately after reduction and long contact with humid air is avoided.

The sintering activity of an Mo powder increases with increasing specific surface area since the reduction of the surface energy is the driving force for sintering. It is also known that the temperature at which the powder begins to sinter is also reduced with increasing specific surface area; likewise the shrinkage rate since the driving force for sintering increases with increasing specific surface area. Both properties can easily be measured, for example by dilatometric analysis or determination of the specific surface area by various established methods using gas adsorption. When the specific surface area of the Mo powder exceeds a particular threshold value, the rate of shrinkage can exceed the rate of oxygen removal. This results in the Mo powder not being able to be sintered to produce dense parts or bodies above a particular specific surface area limit. However, when the specific surface area of the Mo powder is too low, the temperature necessary to achieve the required density in the sintered state increases. However, removal of oxygen becomes easier when initial values in the powder are relatively low. It is therefore practical for an Mo powder for sintering purposes to have a specific surface area within a middle range of specific surface area, as a result of which both aspects (shrinkage and degassing) are taken into account and can be controlled.

Molybdenum metal powder for producing sintered parts is usually produced on an industrial scale by a two-stage process, as follows: in a first stage, a molybdenum salt, e.g. ammonium dimolybdate (ADM), is heated in a hydrogen-containing atmosphere and converted into an intermediate which consists predominantly of $MoO_2$ and can contain relatively small proportions of elemental Mo, $Mo_4O_{11}$ or $MoO_3$. The intermediate additionally contains further trace elements such as Fe, Cr, Si, Cu, K, Na which originate from the ammonium molybdate used. In a second process step, the intermediate is then heated in a hydrogen-containing atmosphere and reduced to Mo metal powder. The reduced Mo powder is subsequently sieved, homogenized and characterized before being pressed and sintered. The first process step and also the second process step are generally carried out in a furnace of the pusher type, although the first step can also be carried out in a rotary furnace. In the second step of the two-stage process according to the prior art, the reduction gas is introduced in countercurrent to the material. It is also prior art to allow the nominal temperature of the heating zones in the second process step (i.e. the temperature of the heated space between the furnace tube and the outer wall of the furnace) to rise from the first heating zone to the last heating zone, with the first heating zone being that in which the material first enters the furnace, A. N. Zelikman et al., "Metallurgiya redkych metallow", Metallurgiya, Moscow 1978, page 146.

When the two process steps described are combined with essentially $MoO_2$ as isolated intermediate for producing Mo metal powder, this is referred to as the "two-stage process". This two-stage process for producing Mo metal powder is often varied in various ways.

Instead of ADM, it is also possible to use ammonium heptarnolybdate (AHM), any other ammonium molybdates or molybdic acid in the first step for producing the intermediate $MoO_2$.

The feed material to the first step of the two-stage process can also be a molybdenum oxide other than $MoO_2$, e.g. $MoO_3$ which is obtained by heat treatment of ammonium molybdate, molybdic acid, impure or technical-grade $MoO_3$ or molybdenum scrap. The result is then a three-stage process since the first step of the two-stage process is preceded by a further process step, as described, for example, in Powder Metallurgy and Metal Ceramics 38(9-10), 429 (1999). The advantage of the three-stage process is that two process steps, namely the endothermic decomposition of ammonium molybdates into $MoO_3$ and the exothermic formation of $MoO_2$ from $MoO_3$, can be carried out as two different processes in different plants so that these processes can be controlled more easily. A further advantage is that no ammonia/hydrogen gas mixture which is difficult to handle is formed in the furnace during the preparation of $MoO_2$ from $MoO_3$. When this is incinerated, environmentally harmful nitrogen oxides are formed; when it is fed to a closed hydrogen recycled loop, it is difficult to remove the ammonia and the nitrogen formed therefrom in a controlled manner. However, in the three-stage process, the two offgases can be treated separated and adequately without hydrogen being unnecessarily consumed or nitrous gases being formed.

The two-stage process can also be modified by combining the first step and the second step in one and the same furnace ("single-stage process"), as described in US 2006/0086205 A1. The disadvantage of this process is the formation of an atmosphere containing ammonia and hydrogen (gas mixture). Process control and control of the product properties also appears to be more difficult to achieve because three chemical reactions having different enthalpies of reaction have to be controlled here, namely the decomposition of ammonium molybdates into $MoO_3$ (endothermic), the formation of $MoO_2$ from $MoO_3$ (exothermic) and the formation of Mo from $MoO_2$ (endothermic).

US 20010049981 A discloses a single-stage reduction of $MoO_3$ to Mo metal powder. This process requires a very steep temperature gradient in the furnace in order to avoid thermal runaway in the first exothermic reduction of $MoO_3$ to $MoO_2$. When the hydrogen flows through the furnace in countercurrent to the material, it is difficult to control the temperature of the material in the first low-temperature zone since the stream of hydrogen introduces additional heat into the furnace tube. Moreover, US 20010049981 discloses neither properties of the Mo powder resulting from the process nor its suitability for producing pressed or sintered parts.

The chemical purity of sintered molybdenum is defined by ASTM B 386-3. These requirements can be met using ammonium molybdates from chemical refining as starting material in the first process step or using $MoO_3$ prepared from these ammonium molybdates. These requirements cannot be met, for example, when a sublimed $MoO_3$, roasted Mo scrap or roasted $MoS_2$ concentrate as results from flotation of mineral ores is used as starting material. Instead of ammonium molybdates, it is also possible to use molybdic acid having a sufficient purity.

In addition to the traditional heat treatment in pusher furnaces for producing Mo metal powder, in which boats or dishes laden with material (predominantly $MoO_2$) are pushed through the furnace, increasing attention is being paid to rotary tube furnaces. In rotary tube furnaces, the material to be processed is moved by gravity through an inclined rotating tube which is heated from the outside to the desired temperature. Owing to its motion and the avalanche-like descent of the powder bed, later also referred to as "moving bed", heat transfer through the tube and into the powder bed is much more effective, which is of importance for control of the reaction when the reaction enthalpy as absolute parameter is high and positive, i.e. the reaction which proceeds is endothermic. This makes control of the reaction rate easier compared to static reduction in boats or dishes. This also applies to the transport of gaseous reaction products or starting materials such as water or hydrogen. For these reasons, the process step for preparing $MoO_2$ from $MoO_3$ or ammonium molybdates is preferably carried out in a rotary tube furnace in order to aid the dissipation of heat in the strongly exothermic formation of $MoO_2$.

A moving bed can also be generated in a different way, for example by a fluidized-bed technique which results in even more effective gas and heat transfer.

A further advantage of the reduction in rotary tube furnaces is that the life of the material of the tube is greater than in the case of the static reduction process. In the static reduction, the material of the tube begins to creep under the constant load of boats and material at temperatures above 1000° C., which limits the maximum operating temperatures and the life. In a rotary tube furnace, the tube is constantly in motion so that permanent deformation of the tube as a result of material creep is essentially avoided when the speed of rotation of the tube is sufficiently high or is reversible at any speed of rotation.

As in any powder-metallurgical process, control over the properties of the sintered part is achieved by means of the powder processing steps, e.g. pressing, sintering, and by means of the powder properties. The significant powder processing steps and the importance of the powder properties are described below.

Pressing influences the pressed density and the shrinkage of the sintered bodies. The regulating parameters in pressing are pressing pressure, pressing mode (isostatic, uniaxial or multiaxial), with or without organic lubricants and uniformity of the filling of the pressing mold. The preferred pressing mode for relatively large molybdenum parts is isostatic pressing. The higher the pressed density and the more homogeneous its spatial distribution, the higher the density of the sintered pressed part and the strength of the pressed part ("green strength"), which makes the handling of large pressed parts without fracture easier. Most of the sintered molybdenum intended for later forming steps is isostatically pressed at room temperature. In contrast to automated axial pressing in which good and reproducible mold filling quality (uniformity of the filling of the pressing mold) depends on a particular minimum flowability of the powder, the molds in isostatic pressing are much larger and are filled by hand, so that the filling quality does not depend on the flowability of the Mo powder.

The regulating parameters for the sintering process are the time, the temperature, the heating rate and the sintering atmosphere. A higher sintering temperature and longer sintering time increase the density of the pressed parts in the sintered state. The heating rate has to be matched to the size and oxygen content of the pressed part, with the latter being very similar to the oxygen content of the powder. The greater the smallest dimension of the pressed part and the higher the oxygen content of the Mo powder used for producing the pressed part, the longer it takes for the undesirable oxygen to diffuse out of the porous pressed part in the form of water vapor which is formed by reaction with the hydrogen which diffuses in. When this heating rate is not chosen correctly, it is, as is known, difficult to achieve the desired low oxygen content after sintering as specified in ASTM B386-03.

The properties of the powders which influence the sintering properties are described below.

Known specific properties of Mo powders which are relevant to sintering are as follows:

the sintering activity (linked to the primary particle size and characterized, for example, by the specific surface area (BET), or FSSS lab milled, ASTM B330), the oxygen, state of agglomeration and the pressed density. The latter is obtained by pressing the Mo powder under a particular pressure, determining the exterior shape and weight of the pressed part and dividing the two parameters. If the pressed density is significantly below 50% of the theoretical density of molybdenum, achievement of an acceptable density in the sintered state is difficult. Conventional industrial Mo powders which display a pressed density of 50% and above generally have a ratio of FSSS:FSSS lab milled which is not greater than 2. "FSSS" denotes the average particle size in accordance with ASTM B 330, "lab milled" is the average particle size in the deagglomerated state, as described in ASTM B 330. When this ratio is below 2, the Mo metal powder is weakly agglomerated. This reduces the forces required for destroying the agglomerates during compaction. This also leads to a reduction in the internal friction during pressing, which leads to a higher and more uniform pressed density at a given pressing pressure.

The properties of Mo powders are determined by the properties of the $MoO_2$ (whose properties in turn depend on those of the source material one or two generations ago and on the specific production parameters for producing it) and by the thermal process parameters of the reduction step of $MoO_2$ to Mo powder, e.g. temperature and residence time. All these parameters have to be known and controlled in order to obtain the desired behavior in the processing of the Mo powder.

Coarse Mo powders, i.e. those having a low specific surface area of less than 0.5 $m^2/g$, usually have a low surface oxygen content and lead to high pressed densities. Finer Mo powders, on the other hand, display moderate properties but have a higher sintering activity. The density in the sintered state is determined by the pressed density and the sintering activity. Coarse Mo powders are generally preferred for sintering applications since they contain less oxygen which has to be removed during sintering. These commercial powders typically have a particle size of from 3 to 8 μm (determined in accordance with ASTM B 330), a specific surface area (BET) of from 0.1 to 0.9 $m^2/g$ and an oxygen content of <1000 ppm, preferably <700 ppm or even less. They are typically sieved through a 150 μm sieve. The pressed density of these powders is typically greater than 5 $g/cm^3$ when pressing is carried out at 2000 bar or above. The ratio of FSSS/FSSS lab milled is generally less than 1.5, but can be up to 2. Such commercial powders as can be obtained, for example, from H. C. Starck, Inc., Osram Sylvania, and also from other suppliers are produced by static reduction of $MoO_2$ in pusher furnaces and are excellent materials for sintered parts having a low oxygen content and a high density. US 2006/0086205 A1 discloses that the shrinkage of such powders commences at 1500° C., with removal of oxygen from the interior of the porous and sintered parts being concluded with certainty, as a result of which a low oxygen content in the sintered part is ensured.

For the above reasons associated with the process, there has been, as already described, continuing interest in applying the rotary tube furnace metal powder reduction by means of hydrogen as is known for the production of tungsten metal powder from tungsten oxide to the production of sinterable Mo metal powder. The preferred starting material for producing Mo metal powder is, owing to the exothermic nature of the reaction of $MoO_3$ to $MoO_2$, molybdenum dioxide ($MoO_2$), which is prepared, for example, from ammonium molybdates by means of thermal process steps. This $MoO_2$ can also be produced from $MoO_3$ which is in turn prepared from ammonium molybdates or molybdic acid by chemical transformation.

Radschenko at al., Powder Metallurgy and Metal Ceramics 38(9-10), p. 429 (1999), describe the three-stage process in which the first step and a combined second and third step are carried out in a rotary tube furnace. The resulting Mo powder has a specific surface area of from 0.8 to 1.2 $m^2/g$, a pressed density of about 50% at 200 MPa, an oxygen content in the range from 2000 to 3000 ppm and a flowability of from 115 to 136 seconds from a 1/10 inch funnel. The Mo powders which have been reduced in a rotary tube furnace are pressed and sintered for 2 hours at 1200° C. Such powders cannot be processed to produce sintered parts or sintered bodies having a density of 90% and above at such low sintering temperatures. Radschenko indicates neither the density nor the oxygen content in the sintered state. A calculation on the basis of the pressed density reported by Radschenko at 200 MPa and the reported volume shrinkage indicates that the density of the sintered parts is about 86% of the theoretical density. It is thus not apparent whether the powders described are suitable for producing in-specification sintered parts under appropriate conditions and this document therefore gives no teachings with regard to the production of such parts.

US 2006/0086205 A1 describes Mo powders which result from a single-stage process, have a specific surface area of from 1 to 3 $m^2/g$ and begin to sinter at 950° C. This starting temperature is considered to be too low for sintering, since shrinkage commences before removal of oxygen is concluded. No pressed properties or results after sintering are reported. The powders described in US 2006/0086205 are therefore unsuitable for producing sintered parts having a high density and a low oxygen content. Furthermore, the flow properties and a particular fraction having at least 30% above 150 μm, which is important for achieving flowability, are mentioned. The flowability is important for axial pressing with automated filling of the molds by means of a filling shoe, but is unimportant for CIP (cold isostatic pressing) since the filling of the mold is in this case carried out manually and the flowability is therefore not a property relevant to the processability. It is not indicated how the flowability was determined, although a flowability of the powders in the range from 29 seconds to about 64 seconds for 50 g is indicated.

US 20060204395 A1 describes the thermal after-treatment of Mo powders having a specific surface area in the range from 1 to about 4 $m^2/g$. The result is an Mo powder having a specific surface area of not more than 0.5 $m^2/g$ and a flowability of more than 32 seconds per 50 g. This powder displays flowability and a very high tapped density of from 3.2 to 6.5 $g/cm^3$. Owing to densification by rapid heating in a plasma, the oxygen is included in the closed pores which form, so that although the nominal oxygen content of the powder may be low, it cannot be reduced further during sintering, leading to a sintered part having a high oxygen content.

In summary, it can be said that a molybdenum metal powder which leads to high sintered densities and low oxygen contents after sintering cannot be produced in a moving bed by the processes known from the prior art. The known Mo powders produced in a moving bed therefore do not meet the requirements necessary for producing densely sintered parts or bodies.

Proceeding from the prior art, it is an object of the present invention to provide a process which uses a moving bed and by means of which it is possible to produce Mo metal powders which can be processed to give sintered parts or sintered bodies having a density of >94% of the theoretical density and a residual oxygen content of <70 ppm.

A further object of the invention is to provide a molybdenum metal powder which has a low specific BET surface area and a low oxygen content and can be processed to produce dense sintered parts having sintered densities of 96% and above or sintered bodies having a residual oxygen content of less than 30 ppm.

The invention is based on the surprising recognition that Mo metal powders can be produced in a moving bed in such a way that they can be pressed and sintered to produce sintered parts having the desired properties if the formation rate and growth rate of Mo metal nuclei which are formed from molybdenum-containing precursors, e.g. oxides ($MoO_3$, $MoO_2$), under hydrogen are controlled by control of the supersaturation.

The present invention therefore provides a process for producing molybdenum metal powder by reduction of molybdenum-containing precursors in a moving bed, which is characterized in that the reduction is carried out by means of an inflowing atmosphere containing water vapor and hydrogen and having a dew point of ≥+20° C. on entry into the reaction space.

The formation rate and growth rate of the crystal nuclei depend on the supersaturation, as is known from the crystallization of solids from melts or solution by control of the concentration. The thermodynamic variable of the Mo reduction is not the concentration, as would be the case in crystallization, but the oxygen activity defined by the thermodynamics, which has a fixed value when Mo and $MoO_2$ are in equilibrium at a particular temperature. On the other hand, the concentration ratio of water vapor to hydrogen (water which results from the reduction of $MoO_2$ to Mo) also determines the oxygen activity. If this latter oxygen activity is lower than the first (=activity when Mo is in equilibrium with $MoO_2$), the rate of formation of crystal nuclei in the reaction is greater than zero. When they are equal, the reduction process stops, while when the oxygen activity is higher, Mo is oxidized to $MoO_2$ or even to higher oxides.

The reduction of molybdenum-containing precursors is carried out at a dew point of the reducing gas mixture of ≥+20° C., particularly preferably ≥+25° C. and very particularly preferably ≥+30° C.

The dew point is the temperature at which a gas sample containing water vapor displays the very first condensation of liquid or solid water. The water vapor pressure for a gas having a particular dew point is identical to the partial pressure of water at the temperature which can be calculated from the dew point.

In a moving bed, the oxygen activity in the powder bed is much lower than in the static powder bed, so that as a result of higher water vapor contents, the supersaturation and thus the rate of formation of crystal nuclei are higher. As a consequence, many small particles are formed and the specific surface areas of the Mo powder are higher than in the case of static reduction. This leads to the above-described problems of sintering of Mo powders from rotary tube reduction. The introduction of the atmosphere containing hydrogen and water vapor in the process of the present invention, later also referred to as reduction gas mixture or reducing gas mixture, can be carried out in various ways. To reduce or completely avoid supersaturation, the reduction gas mixture is preferably introduced in countercurrent to the movement of the molybdenum-containing precursors to be reduced. Here, it is very important that a defined dew point of the reduction gas mixture is set and maintained.

The reduction gas mixture according to the invention preferably contains up to 50% by volume of nitrogen and/or noble gases, e.g. Ar or He, particularly preferably up to 30% by volume of nitrogen and/or noble gases, particularly preferably up to 25% by volume of nitrogen and/or noble gases.

The reduction can be carried out in various furnaces in which a moving bed of material can be generated, e.g. in a drum furnace (also known as rotary tube furnace), in a fluidized bed, in a moving-bed furnace. The reduction is preferably carried out in a rotary tube furnace of any size. Here, the rotary tube can be horizontal or inclined. The inclination of the rotary tube can be up to 10°, preferably up to 7°, particularly preferably up to 5° and very particularly preferably up to 4°. For reasons of process control, it is important that a inclination of the rotary tube is adjustable, the speed of rotation of the tube in which the product is present can be altered, the heated space has more than one heating zone and the introduction of material is continuous.

To prevent reoxidation of the Mo metal powder formed in the process of the invention, the hydrogen is preferably fed into the reaction space simultaneously in the form of two substreams, firstly a humid substream having a dew point of at least +20° C., preferably at least +25° C., particularly preferably at least +30° C., and secondly a further, dry substream. The dry substream avoids reoxidation of the Mo metal powder. In addition, the dry substream ensures that condensation of water onto the Mo powder in the cooling zone is ruled out. The two substreams can mix with one another in the reaction space. However, the dry substream can also be used in another way.

In a preferred embodiment of the invention, the reduction of molybdenum-containing precursors is carried out in a reaction space which is heated by means of at least two heating zones which can be regulated independently of one another.

In a further preferred embodiment of the present invention, the dry substream passes through the cooling zone of the reduced molybdenum metal powder before it is fed into the reduction zone, with the dry substream having a dew point which is both below the temperature of the molybdenum metal powder present in the cooling zone and below the lowest dew point occurring in the reaction zone. The dew point of the dry substream is therefore advantageously below +20° C., preferably below +10° C., particularly preferably below 0° C. In particular, it is below ambient temperature and also below the temperature of the cooling water which removes heat in the cooling zone.

The humid hydrogen substream is preferably fed into the third heating zone by means of a gas lance which projects through the cooling zone. The two hydrogen substreams (dry and humid) preferably mix in the third heating zone, as a result of which the desired water concentration or the dew point required to control the rate of formation of crystal nuclei is set.

As starting materials for carrying out the process of the present invention, it is possible to use various molybdenum oxides, e.g, $MoO_3$, $Mo_4O_7$ or $MoO_2$ or mixtures thereof. Good results are achieved when molybdenum dioxide $MoO_2$ is used as starting material, since in this case only one reaction step is necessary to arrive at elemental Mo and the reaction can therefore be controlled particularly readily since heat is no longer evolved. Preference is given to using molybdenum dioxide powders having a specific surface area (BET), measured in accordance with ASTM 3663, of ≤2 $m^2/g$, preferably ≤1.8 $m^2/g$, particularly preferably ≤1.5 $m^2/g$. The low BET of these starting materials significantly improves the flowability of the material in the furnace.

It has also been found that the physical and chemical properties of the $MoO_2$ used have a critical influence on the properties of the Mo powder and its behavior during subsequent pressing and sintering. For example, to keep the tendency of the Mo metal powder resulting from the reduction process to stick low or avoid it completely, it is important that the molybdenum dioxides used do not exceed a particular reduction loss. The molybdenum dioxides preferably have a reduction loss of not more than 27% by weight, particularly preferably not more than 25% by weight. If molybdenum dioxides having a content of alkali metals (e.g. Na, K, Li) of up to 0.25% are used for the reduction, particularly coarse Mo metal powders can be produced.

It has also surprisingly been found that Mo powders which have been reduced by means of hydrogen/water mixtures have a lower oxygen content than powders which have been reduced by means of pure hydrogen using the same process parameters. This can also be seen from the examples. A person skilled in the field of powder-metallurgical production of Mo metal powders by reduction with hydrogen would expect the opposite.

The invention also provides molybdenum metal powders which can be obtained by the process of the invention.

The invention further provides molybdenum metal powders which have a specific surface area (BET) measured in accordance with ASTM 3663, of from 0.5 to 2 $m^2/g$, preferably from 0.5 to 1.5 $m^2/g$, particularly preferably from 0.5 to 1.2 $m^2/g$, particularly preferably from 0.5 to 1.0 $m^2/g$, very particularly preferably from 0.5 to 0.8 $m^2/g$, a flowability of ≥140 sec per 50 g of powder, measured in accordance with ASTM B 213 and an oxygen content of from 0.07 to 0.5%, preferably from 0.07 to 0.3%, particularly preferably from 0.07 to 0.1%, very particularly preferably from 0.08 to 0.1%.

Further preferred Mo powders according to the invention have properties summarized in Table 1:

TABLE 1

| BET, $m^2/g$ | Oxygen content, % | Flowability, sec per 50 g of Mo powder |
|---|---|---|
| 0.5-1.8 | 0.07-0.5 | >140 |
| 0.5-1.5 | 0.07-0.4 | >140 |
| 0.5-1.2 | 0.07-0.3 | >140 |
| 0.5-1.0 | 0.07-0.2 | >140 |
| 0.5-0.8 | 0.07-0.1 | >140 |
| 0.8-1.8 | 0.1-0.5 | >140 |
| 0.8-1.5 | 0.1-0.4 | >140 |
| 0.8-1.2 | 0.1-0.3 | >140 |
| 0.8-1.0 | 0.1-0.2 | >140 |
| 1.0-2.0 | 0.2-0.5 | >140 |
| 1.2-2.0 | 0.3-0.5 | >140 |

The Mo metal powders of the invention preferably have an FSSS/FSSS lab milled ratio of ≥1.4 and ≤5, particularly preferably ≥1.4 ands ≤3, very particularly preferably ≥1.4 and ≤2.5. The Mo powders of the invention preferably have a particle size FSSS, measured in accordance with ASTM B 330, of from 2 to 8 μm, particularly preferably from 2 to 7 μm, very particularly preferably from 3 to 5 μm.

The molybdenum powders of the invention can be used/processed particularly advantageously to produce in-specification sintered components. The molybdenum metal powders of the invention can be produced by the process described above.

The Mo metal powders of the invention can be used in various powder-metallurgical processes. They are particularly useful for producing pressed parts and sintered parts. The pressed parts and sintered parts can either consist entirely of the Mo metal powder of the invention or contain other additives (e.g. titanium, tungsten, carbides, oxides which are stable under sintering conditions, e.g. lanthanum oxide or zirconium oxide) in addition to molybdenum.

EXAMPLES

The following examples serve to illustrate the invention. All examples were carried out in the same rotary tube furnace having the following data:

Length of the heated space: 3 m

Internal diameter of the tube: 22 cm

Heating of the rotary tube furnace was effected by means of 3 electrically heated zones. The heating zones were separate and could be regulated independently of one another.

The $MoO_2$ feed rate of 4 kg/h was the same in all examples and was kept constant over time by regulation of the mass flow.

All resulting Mo metal powders were sieved as described through a sieve having a mesh opening of 400 μm or 150 μm after discharge from the furnace, analyzed and tested to determine their pressing and sintering properties.

The following measurement methods were employed for analyzing the Mo metal powders in the examples below:

Particle size, μm FSSS (Fisher subsieve Sizer)—ASTM B 330

Specific surface area, BET—ASTM D 3663

Flowability (also referred to as Hall flow)—ASTM 213-03 using 50 g,

Tapped density, $g/cm^3$—ASTM B 527

FSSS (lab milled, (l.m.))—ASTM B 330

Comparative Example 1

Mo metal powders which had been prepared by a two-stage reduction process in which the reduction to the metal powder was carried out in a static bed were used. The analyzed properties were as follows:

a) Mo metal powder grade "MMP", manufactured by H. C. Starck Inc., Newton Mass., USA FSSS 4.5 μm FSSS lab milled—4.3 μm Oxygen content—0.07%

Specific surface area BET—0.23 $m^2/g$

Flowability (Hall flow): did not flow

Fraction+150 μm<0.1%

Tapped density—2.3 $g/cm^3$.

b) Mo metal powder grade " " from Osram Sylvania, USA.

FSSS—5 μm

FSSS lab milled—3.66 μm

Oxygen—0.09%

Specific surface area—0.27 $m^2/g$

Flowability (Hall flow): did not flow

Fraction+150 μm<0.1%

Tapped density—2.7 $glcm^3$.

The powders were pressed to give compacts. The green strength of the compacts was determined as follows:

1.3 g of powder were pressed uniaxially in a round mold having an internal diameter of 10 mm at 200 MPa to give 5 pellets. These were crushed while standing upright by means of a Chatillon tester. The 5 readings were averaged. The results were 156 N for a) and 164 N for b).

The pressed density was determined after uniaxial pressing of 1.5 g of powder in the same mold at a pressing pressure of 230 MPa. The results were 6.44 g/cm$^3$=63% density for a) and 6.19 g/cm$^3$=60.6% for b).

The flowability (Hall flow) was determined in accordance with ASTM B 213-03 using 50 g of powder and the 1/10" funnel described. When no flow was possible after gentle tapping of the edge of the funnel, the result was recorded as "did not flow", which corresponds to a flowability reported in seconds of infinity (in some examples also denoted by "i").

The tapped density was determined in accordance with ASTM B 527 using a 25 ml cylinder.

Both powders were isostatically pressed. A silicone rubber tube having an internal diameter of 25 mm was closed at one end, then filled manually with the metal powder to a length of about 10 cm, closed at the second end and pressed in a waterbath at 230 MPa for 2 minutes. The rubber tube was then cut open and removed. The compacts were examined to ensure that no water had penetrated at the closed ends.

The subsequent sintering was carried out in a dry stream of hydrogen having a dew point below −30° C. using a heating rate of 60° C./h. Sintering at the final temperature of 1790° C. was carried out for 16 hours. After cooling to room temperature in dry hydrogen, the density in the sintered state was measured by means of a density balance (Archimedes principle). The sintered pressed bodies, later also referred to as sintered bodies, were then crushed in a steel mortar and analyzed for oxygen. The density of the sintered bodies was 9.75 g/cm$^3$=95.4% for a) and 9.65 g/cm$^3$=94.4% for b). The oxygen content of the pressed bodies was as follows:

a) 23 ppm and b) <10 ppm.

It can be seen from the analyses of the powders that the two powders differ somewhat in terms of the degree of agglomeration (ratio of FSSS/FSSS lab milled) and lead to different densities in the sintered state and different oxygen contents. Both powders are, according to the results after sintering, suitable for producing sintered molybdenum for later shaping steps.

Example 2

(a+b) According to the Invention, (c) Comparative Example a)

$MoO_2$ produced from ADM by reduction in a rotary tube furnace was used as starting material.

Analysis of the $MoO_2$ gave the following values:

specific surface area: 2.06 m$^2$/g, reduction loss in hydrogen: 24.93% sieved through a sieve having a mesh opening of 1000 μm

Three different Mo metal powders were produced from the above $MoO_2$ in the above-described rotary tube furnace. Reduction was carried out under the following conditions:

rotational speed of the rotary tube—3.5 rpm, inclination of the tube—3.5° feed rate of $MoO_2$—4 kg/h volume flow of hydrogen—total of 15 standard m$^3$/h volume flow of nitrogen—1 standard m$^3$/h.

The temperature settings were 950° C. in the first heating zone, 1000° C. in the second heating zone and 1050° C. in the third heating zone. The volume flow of hydrogen of 15 standard m$^3$/h was divided into two substreams having equal volumes, with the first, dry substream being fed into the cooling zone and the second substream flowing through a warmed waterbath and being humidified in this way. This humid substream was introduced directly into the third heating zone. The resulting calculated dew point after mixing of the two volume flows was +25° C.

Example b) was carried out in the same way as Example a) but a different $MoO_2$ which had been prepared from $MoO_3$ was used. The specific surface area of the $MoO_2$ was 0.16 m$^2$/g and the reduction loss in hydrogen was 24.83%.

Example c) was carried out in the same way as a) but the stream of hydrogen was not humidified.

All powders were sieved through a 400 μm sieve after reduction and analyzed. The further processing of the powders to produce compacts and sintered bodies was carried out in a manner analogous to Example 1. The test results are shown in Table 2.

TABLE 2

| Mo metal powder obtained according to Example | a) | b) | c) |
|---|---|---|---|
| FSSS, (μm) | 8.1 | 4.39 | 11.9 |
| FSSS lab milled, (μm) | 1.34 | 1.92 | 4 |
| Oxygen content, (%) | 0.11 | 0.08 | 0.07 |
| Specific surface area, BET (m$^2$/g) | 1.05 | 0.6 | 0.64 |
| Flowability (s/50 g) | 50 (1/10") | did not flow | did not flow |
| Sieve fraction +150 μm, (%) | 4.5 | 19 | 2.6 |
| Tapped density (g/cm$^3$) | 2.6 | 2.0 | 3.3 |
| Green strength of the compacts, (N) | >170 | >170 | 137 |
| Green density of the compacts, (% of the theoretical density) | 46.3 | 51 | 48.4 |
| Density of the sintered bodies (% of the theoretical density) | 92.95 | 96.9 | 87.1 |
| Oxygen content of the sintered bodies, (ppm) | 34 | 15 | 305 |

Comparison of the results for powders a) and c) shows that the dew point of the reducing hydrogen atmosphere has a very decisive influence on the degree of agglomeration of the Mo metal powders. The latter influences both the green strength of the compacts and also the properties of the sintered bodies. Powder a) corresponds to the requirements which the sintered part has to meet much better than powder c), which is far removed therefrom. It is assumed that very much smaller crystal nuclei are formed during the reduction to powder c) as a result of a higher rate of formation of crystal nuclei. This results in very fine Mo powders which sinter together easily and form closed porosity and whose oxygen content cannot be reduced during sintering and prevents further densification of the sintered bodies.

Comparison of the results for powders a) and b) shows that the specific surface area of the $MoO_2$ has a decisive influence on the specific surface area of the metal powder and therefore on the results after sintering. Powder b) fulfills the requirements which sintered molybdenum has to meet. It can be seen from this example that the specific surface area of the $MoO_2$ should not exceed 2 m$^2$/g in a rotary tube reduction process for producing Mo metal powder and that the effective dew point of the hydrogen stream which enters the heating zone should be above +20° C.

The example also clearly demonstrates that good flowability and good sinterability are two mutually exclusive powder properties. The reason is that a low degree of agglomeration (i.e. a low ratio of FSSS divided by FSSS lab milled) hinders flowability but increases the sinterability and pressability.

Example 3

(a) and c) According to the Invention), b) Comparative Example

All experiments were carried out using an $MoO_2$ prepared from $MoO_3$. This $MoO_2$ had a specific surface area of 0.24 $m^2/g$ and a reduction loss of 24.92%. All experiments were carried out under the following conditions: the temperature in the first temperature zone was 1020° C., that in the second zone was 1070° C. and that in the third zone was 1120° C. The dew point of the hydrogen was +42° C. The hydrogen was introduced in a manner analogous to Example 2a) as humid and dry substreams which after mixing had a dew point of +42° C.

Powder a) was produced fully continuously for 200 hours, each sublot is representative of each 50 h. Average samples were taken therefrom.

Powder b) was produced without humidification of the hydrogen. Powder c) was produced without the dry hydrogen substream, with the cooling zone being supplied with 15 standard $m^3/h$ of hydrogen. The hydrogen was humidified by the hydrogen flowing through water at a temperature of 42° C.

The resulting Mo powders were analyzed in a manner analogous to Example 1, then pressed and subsequently sintered. The results are summarized in Table 3.

TABLE 3

| Mo metal powder obtained according to Example | a) | b) | c) |
|---|---|---|---|
| FSSS, (μm) | 4.79, 4.61, 4.05, 4.59 | 6.38 | 4.48 |
| FSSS lab milled, (μm) | 1.96, 1.88, 1.74, 1.82 | 2.34 | 2.3 |
| FSSS/FSSS lab milled (—) | 2.4, 2.4, 2.3, 2.5 | 2.7 | 1.9 |
| Oxygen content of the Mo powder, (%) | 0.08, 0.07, 0.07, 0.07 | 0.14 | 1.08* |
| Specific BET surface area, ($m^2/g$) | 0.53, 0.54, 0.58, 0.59 | 0.6 | 0.56 |
| Sieve fraction, +150 μm (%) | average of 45.3 | 59.2 | 73.4 |
| Flowability, (seconds/50 g) | average of i | i | i |
| Tapped density, $g/cm^3$ | 2.1 | 1.9 | 1.8 |
| Green strength of the compacts, (N) | >170 | >170 | 128 |
| Green strength of the compacts, (% of the theoretical density) | 51.7, 52.1, 52.3, 52.2 | 49.2 | 54.1 |
| Density of the sintered bodies, (% of the theoretical density) | 96.97, 97.36, 97.75, 97.55 | 95.7 | 97.45 |
| Oxygen content of the sintered bodies, (ppm) | 13, 15, 11, 12 | 12 | 16 |

*predominantly adsorbed water

Powder c) contained condensed moisture and was dried at room temperature under reduced pressure before being analyzed further.

The series of powders a) shows the accuracy of the sum of the methods employed for characterization and the method variations which make it possible to judge the relevance of the differences from powders b) and c).

Powder a) is completely suitable for producing sintered molybdenum for later shaping steps. Although powder b) gave a sintering result corresponding to requirements, its use in large sintered parts is difficult because the oxygen content of the powder (1400 ppm=0.14%) is too high and the green density is below 50%.

Powder c) cannot be used on a large scale because vacuum drying at room temperature cannot be carried out and drying in air would lead to formation of hydroxides which would have to be removed during sintering on the powder surface. Powder c) is less strongly agglomerated and displays somewhat better pressing properties, which can be attributed to the spatially more homogeneous humidity distribution during the reduction (no mixing of the two different substreams). Example a) shows that control of supersaturation and as a result control of agglomeration are critical in order to obtain compacts having open porosity. The advantage of a) over c) is that the powder does not have to be dried. The divided introduction of the hydrogen streams prevents condensation or absorption of water on the Mo powder in the cooling zone.

Example 4

Comparative Example

An $MoO_2$ prepared from ADM and having a BET surface area of 0.35 $m^2/g$ and a reduction loss of 27.14% was used for producing Mo metal powder. According to the reduction loss and X-ray analysis, this $MoO_2$ contained a proportion of $Mo_4O_{11}$. The reduction was carried out in the same way as in Example 3a). Severe caking of the powder bed in the rotary tube was observed, together with hard pellets which had a diameter of up to 10 cm and contained unreduced $MoO_2$ in their interior. The resulting Mo powder fraction below 400 μm still displayed an oxygen content of 0.7%. This experiment showed that $Mo_4O_{11}$ present in the $MoO_2$ leads to caking during the reduction process. This is attributed to the disproportionation of $Mo_4O_{11}$ into $MoO_2$ and volatile $MoO_3$ which holds the pellets together. Owing to the slowed diffusion in pellets, the reduction time necessary to achieve relatively low oxygen contents is increased and the space-time yield is thereby reduced.

Example 5

Example 4 was repeated, but the $MoO_2$ was after-treated with hydrogen in order to convert the $Mo_4O_{11}$ present into pure $MoO_2$. The specific surface area after this transformation was 0.3 $m^2/g$. The reduction loss in hydrogen was 24.99%, which corresponded to the calculated value for pure $MoO_2$ (=25%). The pure $MoO_2$ was then reduced as described in Example 3a), analyzed, characterized and sintered as described in Example 1.

The Mo metal powder obtained displayed the following analysis:

FSSS—2.3 μm
FSSS l.m.—1.58 μm
Oxygen content—0.12%
Specific surface area—0.77 $m^2/g$
Flowability—did not flow
Sieve fraction, ±150 μm—712%
Tapped density—1.8 $g/cm^3$
Green density of the compacts—50.5%.

The measured density of the sintered bodies after pressing and sintering was 98.7% and the oxygen content was 24 ppm.

Examples 4 and 5 show that $MoO_2$ having a reduction loss of less than 27% leads to avoidance of pellet formation and that $MoO_2$ is completely reduced in the moving bed to give an Mo metal powder which leads to dense Mo sintered bodies in later shaping steps.

A very high density in the sintered state was obtained even though the Mo powder does not flow and has a very high proportion of particles above 150 μm.

Example 6 a) An $MoO_2$ having a specific surface area of 1.86 to 2.01 $m^2/g$ was prepared from homogenized ammonium dimolybdate (ADM) and displayed a reduction loss of 25.05-25.7% (both ranges are attributable to different samples which were taken from the continuously operated rotary tube furnace at different points in time and indicate the highest and lowest results which were obtained as a result of process fluctuations). The $MoO_2$ was sieved through a sieve having a mesh opening of 1 mm. The resulting $MoO_2$ was mixed and reduced under the following conditions: the first temperature zone was heated to 950° C., and the second and third zones were each heated to 1050° C. The speed of rotation of the tube was 2 rpm.

The Mo powder obtained was sieved through a 400 μm sieve and subsequently analyzed. The analytical results were as follows:

FSSS 5.45 μm
FSSS l.m.—1.2 μm
Oxygen content—0.22%
Specific surface area—1.28 $m^2/g$
Flowability, Hall flow, 68 seconds
Sieve fraction+150 μm—40.4%
Tapped density—2.3 $g/cm^3$,
Green density of the compacts—44.3%
Green strength of the compacts >170 N.

After pressing and sintering, the sintered bodies had a density of 96.37% and an oxygen content of 73 ppm.

b) The Mo powder from Example 6a) was then mixed for 15 minutes in a high-speed shear mixer in order to produce a homogeneous batch. The resulting Mo metal powders were analyzed with the following result:

FSSS—2.97 μm
FSSS l.m.—1.14 μm
Oxygen content—0.23%
Specific surface area—1.28 $m^2/g$
Flowability—did not flow
Sieve fraction+150 μm 15%
Tapped density—2.98 $g/cm^3$
Green density of the compacts—45.3%
Green strength of the compacts—134 N.

After pressing and sintering, the sintered bodies had a density of 98.8% and an oxygen content of 20 ppm.

This Example 6 shows that the mixing and sieving steps which reduce the ratio between FSSS and FSSS l.m. or the size of the agglomerates (e.g. content of agglomerates from 400 to 150 μm) also have a positive influence on the density in the sintered state and the residual oxygen content after sintering at the expense of the flowability of the powder.

The density of the pressed bodies in the sintered state from Examples 5 and 6 is so high that no further forming is necessary to achieve even higher densities. This means that the Mo metal powders of the invention are suitable for the pressing and sintering of parts which have final dimensions or virtually final dimensions and require no further forming steps. This likewise means that sintered parts produced therefrom have a low reject rate in subsequent forming processes because of their low oxygen content and their high sintered density.

The above examples also show that the flowability of an Mo powder and the resulting density in the sintered state cannot be optimized independently of one another. The powders of the invention lead to sintered bodies having a very high density at the expense of the flowability, which does not play any particular role in filling of the mold in, for example, isostatic pressing, injection molding or tape casting.

The invention claimed is:

1. Molybdenum metal powder which has a specific surface area, measured in accordance with ASTM 3663, of from 0.5 to 2 $m^2/g$, a flowability of ≥140 sec per 50 g of powder, measured in accordance with ASTM B 213, and an oxygen content of from 0.07 to 0.5%.

2. Molybdenum metal powder according to claim 1, wherein the powder has an FSSS/FSSS lab milled ratio of ≥1.4 and ≤5.

3. Molybdenum metal powder according to claim 1, wherein the powder has an FSSS/FSSS lab milled ratio of ≥1.4 and ≤3.

4. Molybdenum metal powder according to claim 1, wherein the powder has an FSSS/FSSS lab milled ratio of ≥1.4 and ≤2.5.

5. Molybdenum metal powder according to claim 1, wherein the FSSS particle size of the powder, measured in accordance with ASTM B 330, is from 2 to 8 μm.

6. Molybdenum metal powder according to claim 1, wherein the FSSS particle size of the powder, measured in accordance with ASTM B 330, is from 2 to 7 μm.

7. Molybdenum metal powder according to claim 1, wherein the FSSS particle size of the powder, measured in accordance with ASTM B 330, is from 3 to 5 μm.

8. Molybdenum metal powder according to claim 1, wherein the powder has a specific surface area, measured in accordance with ASTM 3663, of from 0.5 to 1.5 $m^2/g$.

9. Molybdenum metal powder according to claim 1, wherein the powder has a specific surface area, measured in accordance with ASTM 3663, of from 0.5 to 1.2 $m^2/g$.

10. Molybdenum metal powder according to claim 1, wherein the powder has a specific surface area, measured in accordance with ASTM 3663, of from 0.5 to 1.0 $m^2/g$.

11. Molybdenum metal powder according to claim 1, wherein the powder has a specific surface area, measured in accordance with ASTM 3663, of from 0.5 to 0.8 $m^2/g$.

12. Molybdenum metal powder according to claim 1, wherein the powder has an oxygen content of from 0.07 to 0.3%.

13. Molybdenum metal powder according to claim 1, wherein the powder has an oxygen content of from 0.07 to 0.1%.

14. Molybdenum metal powder according to claim 1, wherein the powder has an oxygen content of from 0.08 to 0.1%.

15. Molybdenum metal powder according to claim 1, wherein the powder has a tapped density, measured in accordance with ASTM B 527, of from 1.8 to 2.6 $g/cm^3$.

* * * * *